US005493088A

United States Patent [19]

Castonguay et al.

[11] Patent Number: 5,493,088

[45] Date of Patent: Feb. 20, 1996

[54] ASSEMBLY FOR HIGH AMPERE-RATED CIRCUIT BREAKER

[75] Inventors: Roger N. Castonguay, Terryville; James L. Rosen, West Hartford; Mark A. Zaffetti, Windsor Locks, all of Conn.

[73] Assignee: General Electric Company, New York, N.Y.

[21] Appl. No.: 205,240

[22] Filed: Mar. 3, 1994

[51] Int. Cl.[6] ..... H01H 5/00

[52] U.S. Cl. ..... 200/400; 200/401; 200/318

[58] Field of Search ..... 200/400, 401, 200/318, 320, 321, 322, 323, 324, 325, 327, 303

[56] References Cited

U.S. PATENT DOCUMENTS

| | | | |
|---|---|---|---|
| 2,581,181 | 1/1952 | Favre . | |
| 4,001,742 | 1/1977 | Jencks et al. . | |
| 4,344,054 | 8/1982 | Castonguay et al. . | |
| 4,491,814 | 1/1985 | Bellows | 200/401 |
| 4,713,508 | 12/1987 | Baginski et al. . | |
| 4,801,907 | 1/1989 | Kelaita, Jr. et al. . | |
| 4,935,712 | 6/1990 | Oyama et al. | 200/401 |
| 5,082,996 | 1/1992 | Takahashi et al. | 200/401 |

OTHER PUBLICATIONS

Castonguay et al—"Operating Mechanism for High Ampere–Rated Circuit Breakers"; U.S. Ser. No: 08/202140 filed Feb. 25, 1994 (Docket:41PR–7116).

Castonguay et al—"Rating Module Unit for High Ampere–Rated Circuit Breaker"; U.S. Ser. No. 08/203062 Filed Feb. 28, 1994 (Docket:41PR–7124).

*Primary Examiner*—Henry J. Recla
*Assistant Examiner*—David J. Walczak
*Attorney, Agent, or Firm*—Richard A. Menelly

[57] ABSTRACT

This invention relates to a high ampere-rated circuit breaker which meets the electrical code requirements of the world market. The powerful operating springs controlling the circuit breaker contacts are restrained by the interaction of a cradle operator and a two stage latching assembly. The latching assembly includes a primary and a secondary latch to insure against nuisance tripping.

6 Claims, 5 Drawing Sheets

ASSEMBLY FOR HIGH AMPERE-RATED CIRCUIT BREAKER

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

U.S. patent application Ser. No. 08/202,140, filed Feb. 25, 1994 entitled "Operating Mechanism for High Ampere-Related Circuit Breaker", which Application is incorporated herein for purposes of reference describes an operating mechanism capable of immediately resetting the circuit breaker operating mechanism to reclose the contacts without having to recharge the circuit breaker operating springs immediately after opening the circuit breaker contacts.

U.S. patent application Ser. No. 08/203,062, filed Feb. 28, 1994 entitled "Rating Module Unit for High Ampere-Rated Circuit Breaker", which Application is incorporated herein for purposes of referenced describes a circuit breaker closing spring modular unit whereby the circuit breaker operating springs are contained within a separate unit from the operating mechanism and can be installed within the circuit breaker enclosure without disturbing the operating mechanism assembly.

The purpose of this invention is to provide a latching arrangement capable of retaining the circuit breaker operating springs from separating the circuit breaker contacts during quiescent current conditions while insuring release of the operating springs upon the occurrence of an overcurrent condition.

SUMMARY OF THE INVENTION

The circuit breaker operating mechanism operating springs are restrained by the interaction of the operating mechanism cradle with a two-component latching assembly. The primary latch component interfaces with the end of the cradle while the secondary latch component interfaces with the primary latch per se. A positioning pin and a primary latch guide are employed to accurately set the dimensional tolerances between the end of the cradle and the primary latch.

DESCRIPTION OF THE PREFERRED EMBODIMENT

Figure 1:
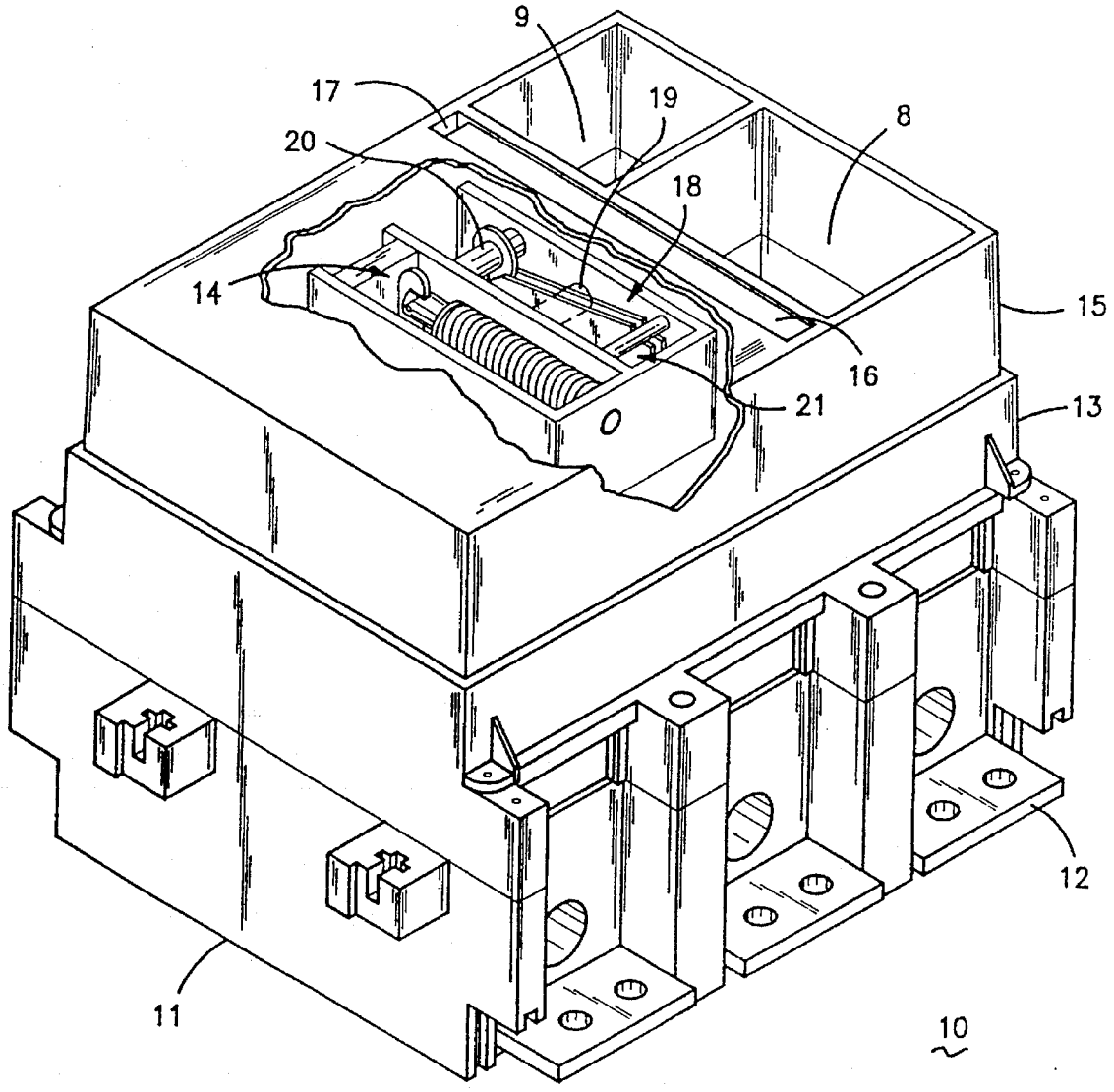
FIG. 1 is a top perspective view of a high ampere-rated circuit breaker with a portion of the circuit breaker cover removed to depict the location of the operating mechanism relative to the latching assembly according to the invention.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 13 of similar insulative material is attached prior to attaching the top cover 15, also consisting of an electrically-insulative material. Electrical connection with the interior current-carrying components is made by load terminal straps 12 extending from one side of the base and line terminal straps (not shown) extending from the opposite side thereof. The interior components are controlled by an electronic trip unit contained within a recess 8 on the top surface of the top cover 15. Although not shown herein, the trip unit is similar to that described within U.S. Pat. No. 4,581,181 and interacts further with an accessory contained within the accessory recess 9 to provide a range of protection and control functions such as described, for example within U. S. Pat. No. 4,801,907. The operating mechanism 18 includes a drive shaft 19 and a closing shaft 20 which interact with a latching system 21 to control the spring forces exerted by the closing spring modular unit 14 which is described in greater detail within the aforementioned U.S. patent application Ser. No. 08/203,062.

Figure 2:
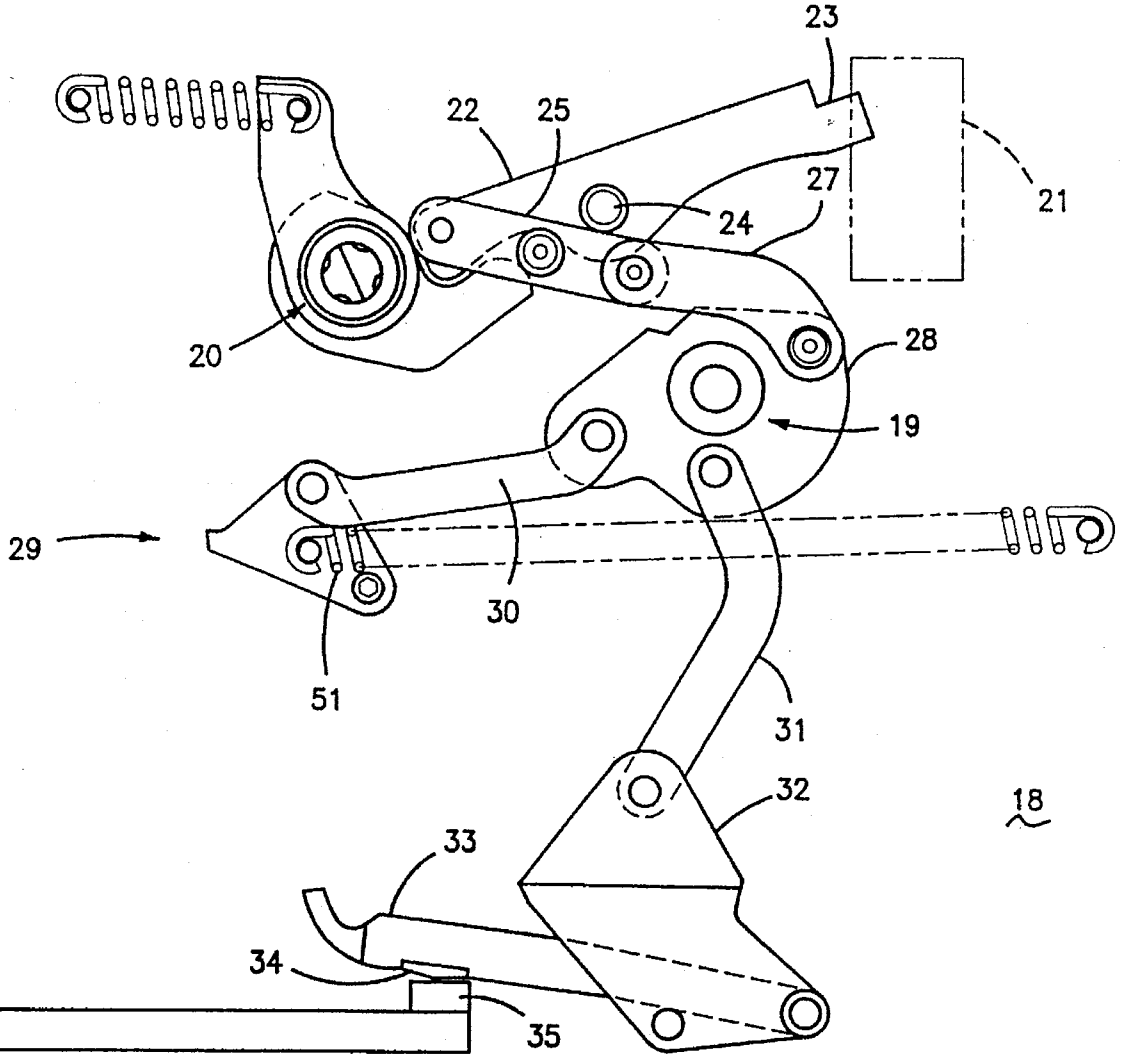
FIG. 2 is a side view of the operating mechanism, latching system and contacts used within the circuit breaker of FIG. 1.

The operating handle 16 located within the handle recess 17 allows manual operation of the circuit breaker operating mechanism 18 to separate the circuit breaker movable and fixed contacts 34, 35 as best seen by now referring to the circuit breaker 10 shown in FIG. 2.

As described within the aforementioned U.S. patent application Ser. No. 08/203,062 the operating mechanism 18 includes a cradle 22 that is supported on the cradle pivot 24 and interacts with the closing shaft 20 by means of the cradle link 25 and the closing link 27. The cradle hook 23 is retained by the latch assembly 21 to prevent the cradle 22 from rotating about the cradle pivot 24 allowing the powerful operating springs 51 to rotate the crank 28 on the drive shaft 19 and lift the contact arm drive link 31, contact arm carrier 32 and contact arm 33 into the TRIPPED condition with the movable contact 34 away from the fixed contact 35, as indicated in phantom. The interface cam 29 connects with the crank 28, interface link 30 and drive shaft 19 to assist in returning the contacts to their CLOSED condition.

Figure 3:
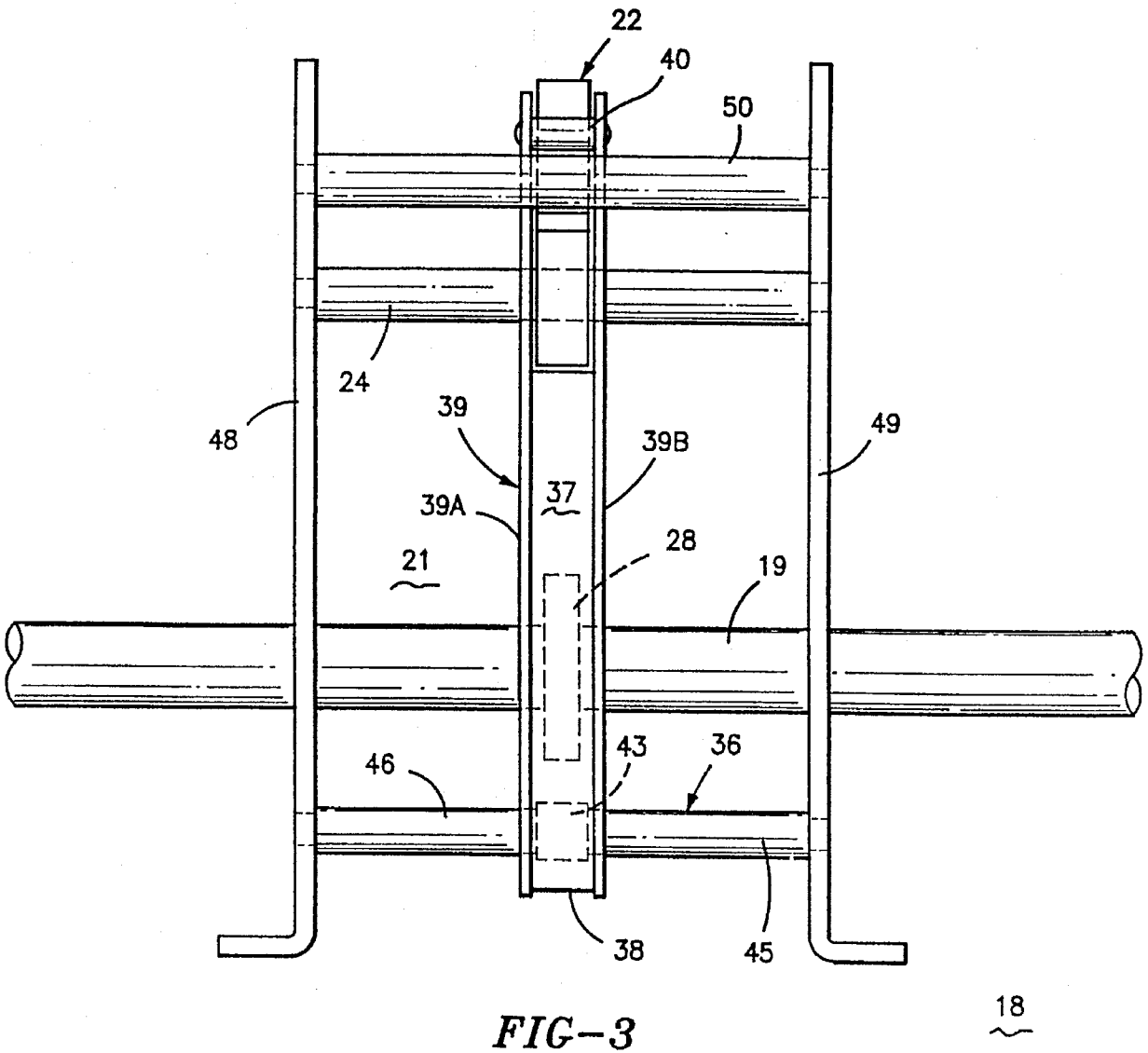
FIG. 3 is a front view of a part of the operating mechanism and latching assembly depicted in FIG. 2.
Figure 4:
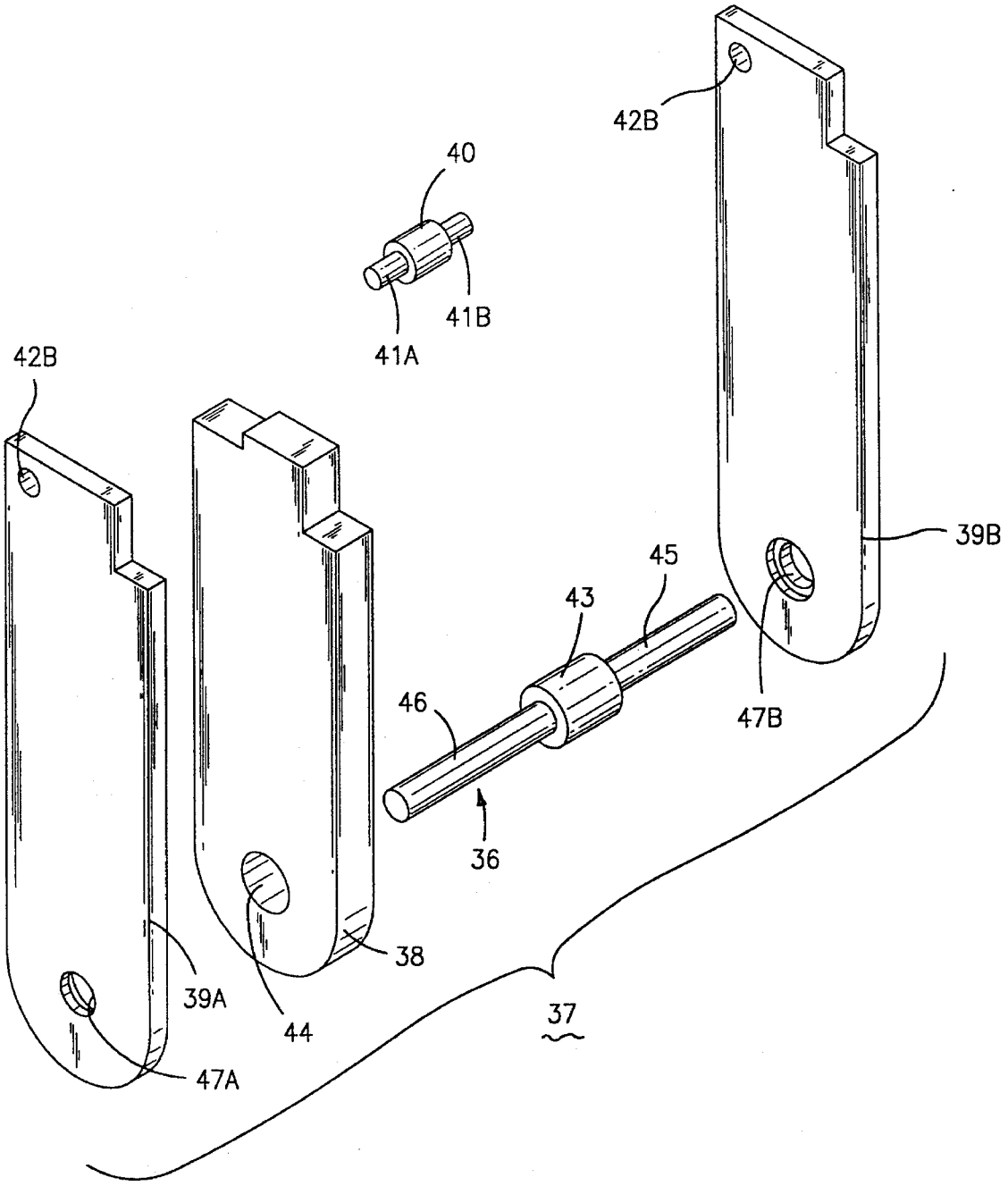
FIG. 4 is an exploded top perspective view of the primary latch component used within the latch assembly of FIG. 2.
Figure 5:
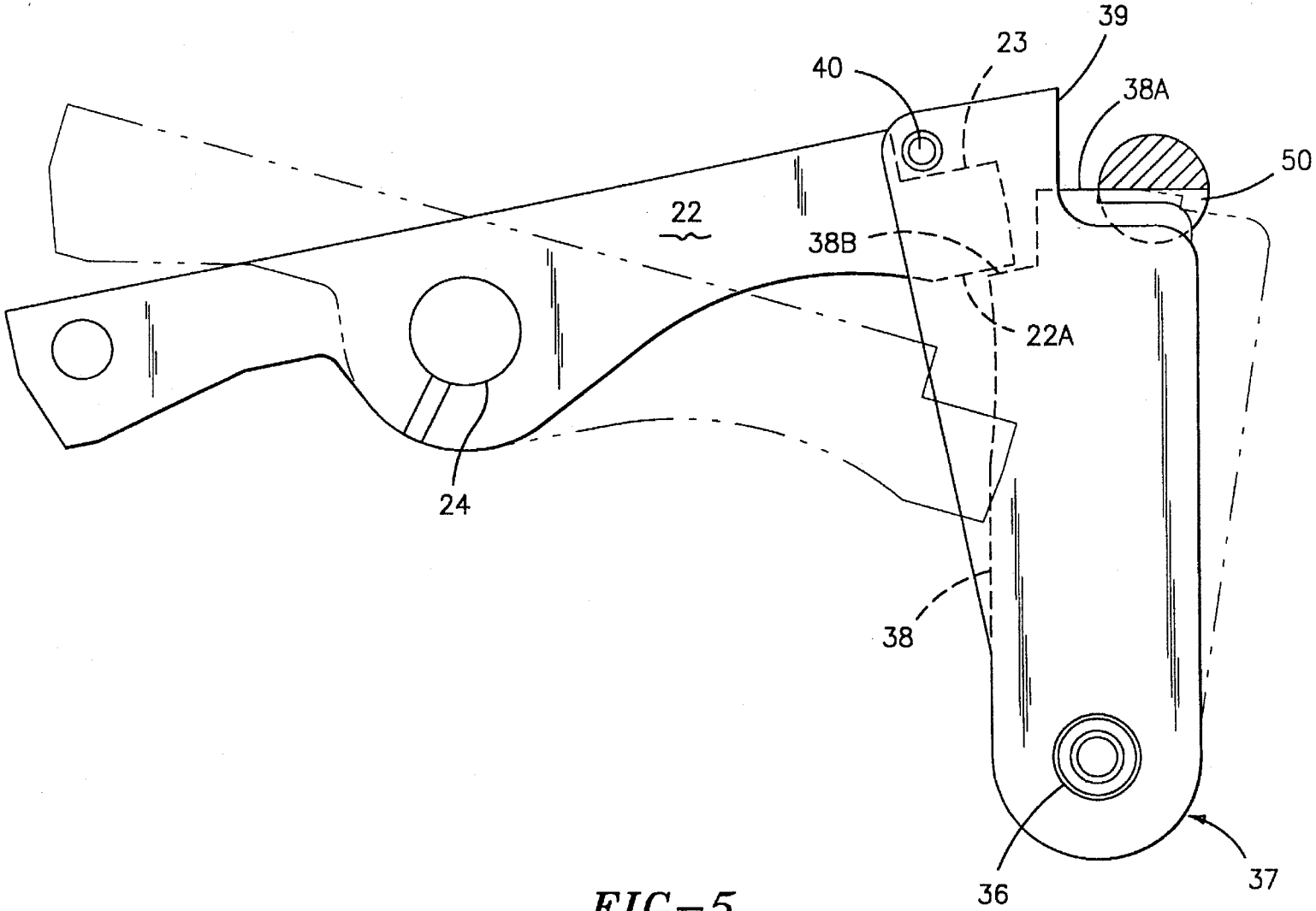
FIG. 5 a side view of the latch assembly and cradle of FIG. 3 depicting the latched and tripped position of the cradle.

In accordance with the teachings of the invention, the latch assembly 21 shown within the operating mechanism 18 of FIG. 3 includes a two stage latch assembly consisting of a primary latch assembly 37 and secondary latch 50. The use of a two stage latch assembly to prevent nuisance tripping is described, for example, in U.S. Pat. No. 4,344,054 entitled "Latch Assembly for Static Trip Circuit Breakers". The operating mechanism sideframes 48, 49 which support the cradle pivot 24, also support the secondary latch 50 as well as the primary latch pivot pin 36. The primary latch assembly 37 consists of a primary latch guide 39 in the form of a pair of guides 39A, 39B held together by means of a positioning pin 40 which further serves to accurately position the primary latch assembly 37 with respect to the cradle 22. The primary latch pivot pin 36 is in the form of a pair of sidearms 45, 46 which support the primary latch 38 and the primary latch central raised cylinder 43. The positioning and operation of the components within the primary latch assembly 37 is best seen by now referring jointly to FIGS. 4 and 5.

The primary latch guides 39A, 39B support the primary latch pivot pin 36 by receiving the sidearms 45, 46 within the corresponding slots 47A, 47B with the central raised cylinder being received within the opening 44 in the primary latch 38 in a press-fit relation. As described earlier, the positioning pin 40 serves to retain and carefully position the primary latch 38 by receiving the support studs 41A, 41B within the corresponding thru holes 42A, 42B. With the cradle 22 in the latched position shown in solid lines in FIG. 5, the cradle hook 23 is retained by the positioning pin 40 to prevent the cradle from rotation about the cradle pivot 24. The contact between the secondary latch 50 and the step 38A formed on the top of the primary latch 38 prevents the cradle latch surface 22A from moving the latch assembly 37 to the TRIPPED position shown in phantom. Upon rotation of the secondary latch 50 out of contact with the step 38A, the cradle latch surface 22A slides across the step 38B allowing the primary latch assembly 37 to rotate clockwise about the primary latch pivot pin 36 and allow the cradle to rotate clockwise about the cradle pivot 24 as indicated in phantom to thereby articulate the operating mechanism 18 shown earlier in FIG. 3.

A simple latching arrangement consisting of a two stage assembly of a primary and secondary latch has herein been described. Reliable articulation of the circuit breaker operating mechanism within close manufacturing tolerances is made possible by this arrangement.

We claim:

1. An industrial-rated circuit breaker for high level overcurrent protection comprising:

an insulative base;

a pair of separable contacts within said base, one of said contacts being attached to a movable contact arm a contact arm carrier connecting said movable contact arm within said base and with a contact arm drive link extending outside said base;

an insulative cover above said base, said cover adapted to enclose a closing shaft and a drive shaft, said drive shaft adapted to connect with said contact arm drive link for thereby moving said contact arm carrier and said contact arm between open and closed positions;

an operating cradle within said cover restraining movement of said contact arm carrier against a bias exerted on said contact arm carrier by means of a pair of operating springs, and a latching assembly within said cover consisting of a primary latch interfering with one end of said cradle to prevent rotation of said cradle and a secondary latch interfering with a top part of said primary latch to prevent rotation of said primary latch, said primary latch comprising a primary latch pivot pin extending between a pair of operating mechanism sideframes said primary latch further includes a central raised cylinder formed on said primary latch pivot pin.

2. An industrial-rated circuit breaker for high level overcurrent protection comprising:

an insulative base;

a pair of separable contacts within said base, one of said contacts being attached to a movable contact arm;

a contact arm carrier connecting said movable contact arm within said base with a contact arm drive link 31 extending outside said base;

an insulative cover above said base, said cover adapted to enclose a closing shaft and a drive shaft, said drive shaft adapted to connect with said contact arm drive link for thereby moving said contact arm carrier and said contact arm between open and closed positions;

an operating cradle within said cover restraining movement of said contact arm carrier against a bias exerted on said contact arm carrier by means of a pair of operating springs;

a latching assembly within said cover consisting of a primary latch interfering with one end of said cradle to prevent rotation of said cradle and a secondary latch interfering with a top part of said primary latch to prevent rotation of said primary latch said primary latch comprising a primary latch pivot pin extending between a pair of operating mechanism sideframes, said primary latch further includes a pair of opposing primary latch guides fastened together by means of a positioning pin.

3. The circuit breaker of claim 1 wherein said secondary latch is rotatably positioned between said operating mechanism sideframes.

4. The circuit breaker of claim 1 wherein said one end of said cradle comprises a cradle hook 23.

5. The circuit breaker of claim 1 wherein said top part of said primary latch comprises a step 38A.

6. An industrial-rated circuit breaker for high level overcurrent protection comprising:

an insulative base;

a pair of separable contacts within said base, one of said contacts being attached to a movable contact arm;

a contact arm carrier connecting said movable contact arm within said base with a contact arm drive link extending outside said base;

an insulative cover above said base, said cover adapted to enclose a closing shaft and a drive shaft, said drive shaft adapted to connect with said contact arm drive link for thereby moving said contact arm carrier and said contact arm between open and closed positions;

an operating cradle within said cover restraining movement of said contact arm carrier against a bias exerted on said contact arm carrier by means of a pair of operating springs; and a latching assembly within said cover consisting of a primary latch interfering with one end of said cradle to prevent rotation of said cradle and a secondary latch interfering with atop part of said primary latch to prevent rotation of said primary latch, said primary latch comprising a primary latch pivot pin extending between a pair of operating mechanism sideframes and a central raised cylinder formed on said primary latch pivot pin.

* * * * *